US006735913B2

(12) United States Patent
Sanders et al.

(10) Patent No.: US 6,735,913 B2
(45) Date of Patent: May 18, 2004

(54) BLOCK WALL SYSTEM

(75) Inventors: Steven H. Sanders, Granite Bay, CA (US); William L. Millhone, Loomis, CA (US)

(73) Assignee: Sanders & Associates Geostructural Engineering, Inc., Granite Bay, CA (US)

( * ) Notice: Subject to any disclaimer, the term of this patent is extended or adjusted under 35 U.S.C. 154(b) by 0 days.

(21) Appl. No.: 10/211,912

(22) Filed: Aug. 1, 2002

(65) Prior Publication Data

US 2004/0020144 A1 Feb. 5, 2004

(51) Int. Cl.[7] ..... E04B 1/04

(52) U.S. Cl. ..... 52/284; 52/270; 52/286; 52/437; 52/505; 52/521; 52/604; 52/606; 52/780; 52/764; 256/19

(58) Field of Search ..... 52/437, 505, 585.1, 52/585.2, 521, 764, 780, 561, 604, 606, 284, 270, 286; 256/19

(56) References Cited

U.S. PATENT DOCUMENTS 3,512,759 A * 5/1970 Resler ..... 256/19
3,717,967 A * 2/1973 Wood ..... 52/259
3,760,594 A * 9/1973 Jurina ..... 405/267
3,855,752 A * 12/1974 Aylon ..... 52/605
3,869,530 A * 3/1975 Williams ..... 264/33
3,902,702 A * 9/1975 Kinnaman ..... 256/19
3,968,615 A * 7/1976 Ivany ..... 52/439
4,272,940 A * 6/1981 Nicolls ..... 52/591.1
4,295,313 A * 10/1981 Rassias ..... 52/438
4,319,440 A * 3/1982 Rassias et al. ..... 52/438
4,688,362 A * 8/1987 Pedersen et al. ..... 52/223.7
4,726,567 A * 2/1988 Greenberg ..... 256/19
4,765,104 A * 8/1988 Boot ..... 52/143
4,769,964 A * 9/1988 Johnson et al. ..... 52/405.4
4,821,483 A * 4/1989 Adams ..... 52/747.12
4,865,781 A * 9/1989 Jennings ..... 264/35
5,007,218 A * 4/1991 Bengtson et al. ..... 52/204.2
5,100,107 A * 3/1992 Latta ..... 256/19
5,355,647 A * 10/1994 Johnson et al. ..... 52/503
5,402,609 A 4/1995 Kelley, Jr.
5,457,926 A 10/1995 Jensen
5,501,057 A * 3/1996 Dawson ..... 52/761
5,575,128 A * 11/1996 Haener ..... 52/572
5,623,797 A * 4/1997 Gravier et al. ..... 52/284
5,794,921 A * 8/1998 Greenberg ..... 256/19
5,878,544 A * 3/1999 McKinnon ..... 52/566
5,890,332 A * 4/1999 Skidmore et al. ..... 52/271
5,899,040 A 5/1999 Cerrato
5,960,604 A * 10/1999 Blanton ..... 52/604
6,065,265 A * 5/2000 Stenekes ..... 52/607
6,098,357 A * 8/2000 Franklin et al. ..... 52/223.7
6,134,853 A * 10/2000 Haener ..... 52/405.2
6,199,832 B1 * 3/2001 Morrow ..... 256/19
6,253,519 B1 * 7/2001 Daniel ..... 52/591.1
6,293,066 B1 * 9/2001 Lohrey ..... 52/396.08
6,393,791 B1 * 5/2002 Mann ..... 52/478
6,431,797 B2 * 8/2002 Greenberg ..... 405/284
6,513,293 B2 * 2/2003 Miller ..... 52/405.1
6,536,170 B2 * 3/2003 Stuever ..... 52/299
6,539,682 B1 * 4/2003 Ryder ..... 52/437
6,571,521 B1 * 6/2003 Ameigh ..... 52/295

* cited by examiner

*Primary Examiner*—Carl D. Friedman
*Assistant Examiner*—Christy Green
(74) *Attorney, Agent, or Firm*—Townsend and Townsend and Crew LLP

(57) ABSTRACT

A masonry block wall system is disclosed comprising a plurality of piers positioned at predetermined intervals with a pilaster mounted on each of the piers. The pilasters are formed by vertically stacked masonry blocks that are attached to the pier by a reinforcing rod extending upwardly from the pier through a vertical mortarless void in the blocks. A plurality of courses of masonry blocks form block wall panels, each of the blocks in the panels having horizontal mortarless voids therein, the horizontal and vertical joints between adjacent courses being interlocking and mortarless. Selected courses of masonry blocks have a horizontal reinforcing rod attached to each block in the course without mortar or grout.

24 Claims, 7 Drawing Sheets

BLOCK WALL SYSTEM

BACKGROUND OF THE INVENTION

The present invention relates to masonry block wall systems, and more particularly to a block wall for use as a fence or retaining wall, constructed of masonry block panels without the use of mortar or grout and supported by pilasters setting upon piers spaced at predetermined intervals along a fence line with or without a grade beam spanning the piers.

The construction of a block wall using known materials and methods is time consuming and requires the expensive skills of a mason. The expense of conventional materials and the time required for building these structures using conventional methods limit the use of these otherwise durable masonry block systems. Unlike wood fences, masonry block wall systems resist weathering and provide a permanent structure that requires little, if any, maintenance. Block walls also provide excellent security and privacy. However, block walls require structural integrity such as the ability to withstand exterior forces like high winds and earthquakes. The fulfillment of these structural requirements is thought to necessitate the use of current building materials and techniques. The utilization of some modern building techniques such as post tensioning along a block wall system provide some savings in time and expense, but post tensioning block wall systems require the use of a mason to construct the system using mortar, and skilled personnel to install and tighten the post tensioning apparatus. Elimination of skill intensive building techniques and outdated materials requiring special skill, and streamlining the process for building masonry block walls would result in substantial savings in time, labor costs, and material costs for building such walls.

Existing masonry block walls require frequent vertically extending reinforcing bars anchored in either a concrete pier and footer, or grade beam at the base of the wall. These vertical reinforcing bars are typically extended upward through voids in the masonry blocks. The voids surrounding the vertical reinforcing bars are either conventionally filled with grout to connect the reinforcing bar to the masonry blocks in the wall, or in the case of post tensioning systems, the reinforcing bar is connected to the masonry by way of a steel plate and nut assembly at the top of the wall.

SUMMARY OF THE INVENTION

The present invention provides a masonry block wall panel and pilaster system supported by piers that eliminates the need for substantial trenching, concrete grade beams and skilled labor. The present invention relies upon piers at predetermined intervals along the fence line with or without grade beams. When used in poor soil conditions, grade beams between the piers along the grade level support the courses of masonry blocks. The piers provide support for the pilasters by way of reinforcing rods that extend vertically from the pier up through the top of the pilaster and are held in place with deflection restraint clips (DRCs). The block wall panels of the present system are constructed between the pilasters, and held in place by the pilasters, with reinforcing rods extending horizontally through voids in the course of masonry blocks, with the reinforcing rods held in place by DRCs. The reinforcing rods may extend horizontally through every other course of blocks or with greater or less spacing. Cap blocks may be placed on top of the block wall system as the top course using common adhesives or DRCs. Constructing a block wall system of the present invention uses substantially less concrete and labor, and does not require skilled labor.

The present invention utilizes conventional masonry blocks that can be positioned on top of a grade beam or simply placed directly on the soil, without the use of conventional mortared joints or grout to connect the reinforcing rods to the blocks. All joints between adjacent blocks are mortarless, accomplished by using interlocking or tongue-and-groove block configurations and reinforcing rods held in place by DRCs. The DRCs eliminate the need for grout by holding the horizontal and vertical reinforcing rods in place.

Advantages of the present invention include a block wall system incorporating the advantages of prior art block wall systems at a much lower cost in materials, time and labor; a block wall system that may be constructed without mortar or grout while providing substantial structural integrity; a block wall system that may incorporate vertical post-tensioning rods along equally spaced pilasters to increase structural strength and the ability of the wall to withstand external forces; a block wall system that may include post tensioning rods at all or some of the pilasters; a block wall system that minimizes or eliminates the need for skilled labor in the construction of the block wall system; a block wall system that may incorporate grade beams spanning pier footings along a fence line; a block wall system that significantly simplifies the construction of a block wall enabling individuals with no experience to build the block wall system.

A further understanding of the nature and advantages of the invention may be realized by reference to the remaining portions of the specification and the drawings.

DESCRIPTION OF THE SPECIFIC EMBODIMENTS

Figure 1:
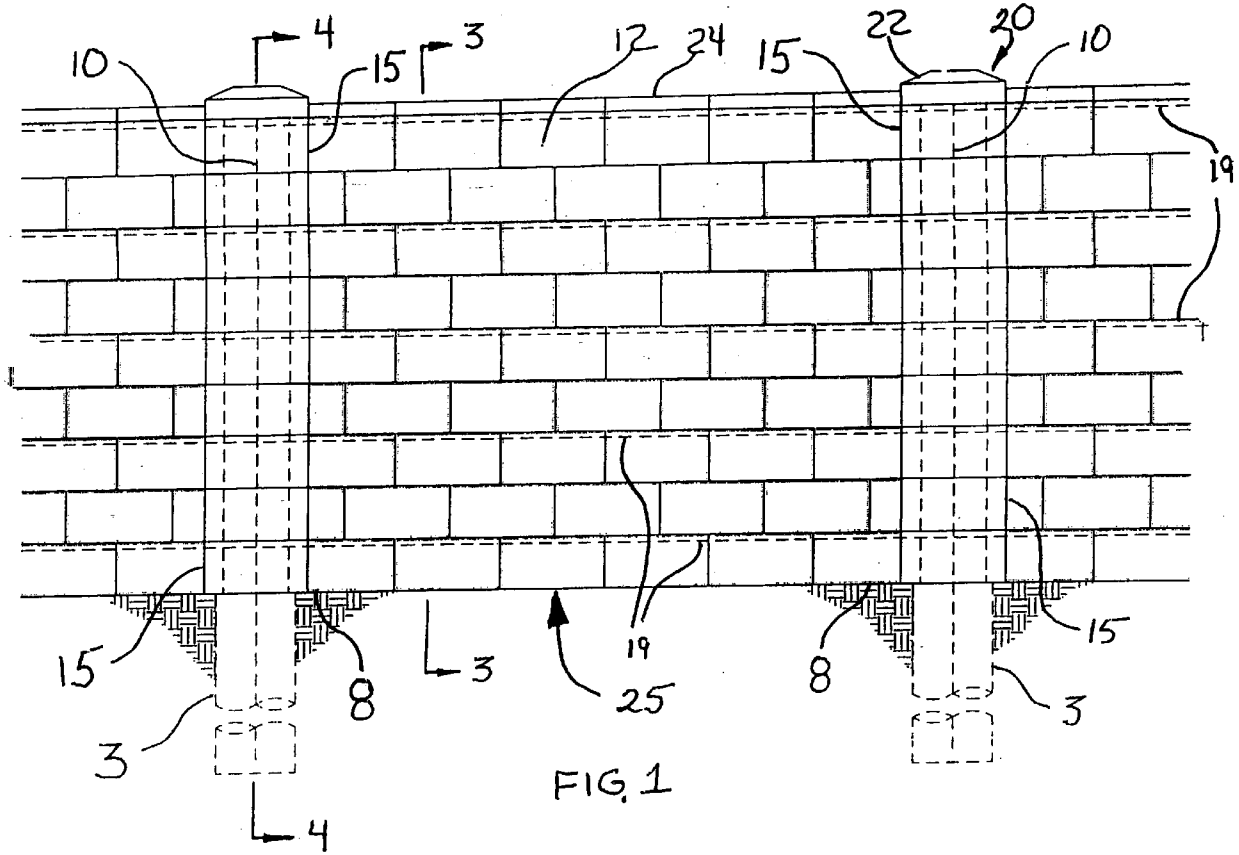
FIG. 1 is a side elevation view of a section of a block wall system constructed in accordance with the teachings of the present invention.
Figure 2:
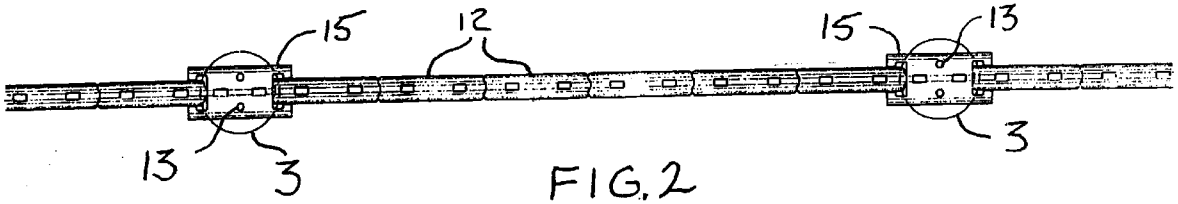
FIG. 2 is a top view of the block wall system of FIG. 1.
Figure 4:
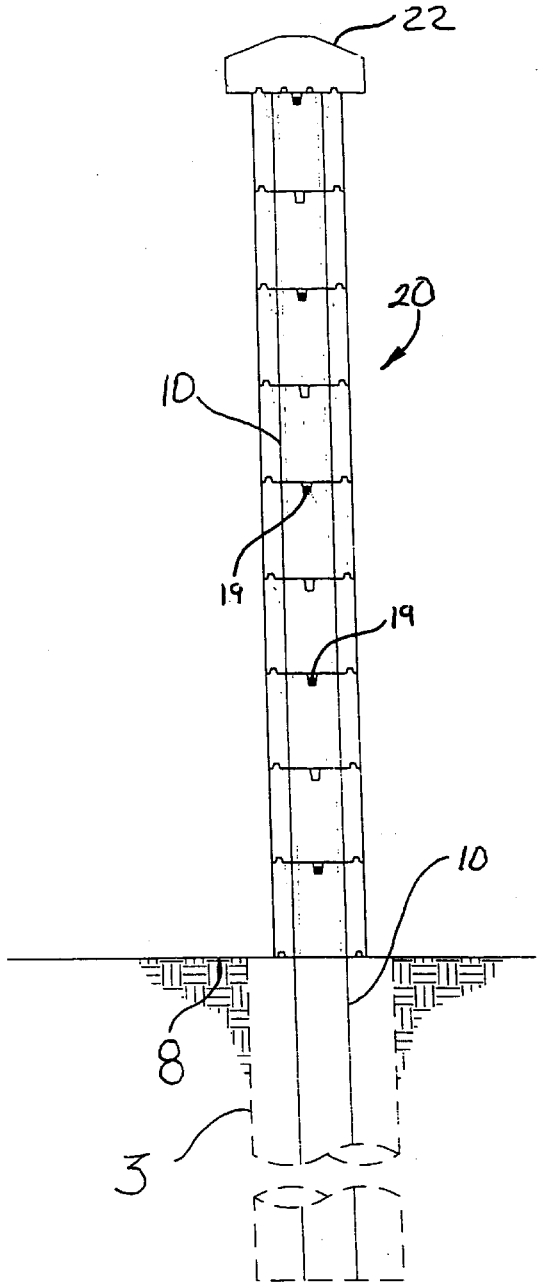
FIG. 4 is a cross-sectional view of the block wall system of FIG. 1 taken along line 4—4.
Figure 5A:
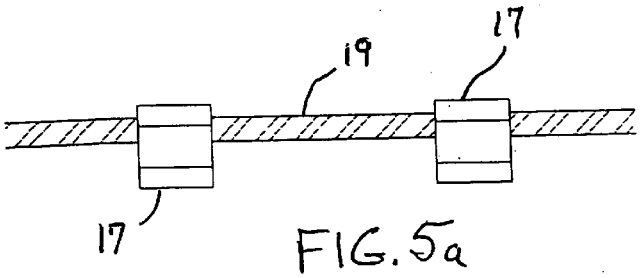
FIG. 5*a* is a side elevation view of a reinforcing rod with DRCs as placed in a masonry panel block used in constructing a course of the panel section of the block wall system of the present invention.
Figure 6A:
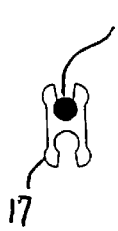
FIG. 6*a* is an end view of a reinforcing rod with DRCs as placed in a masonry panel block used in constructing a course of the panel section of the block wall system of the present invention.
Figure 5B:
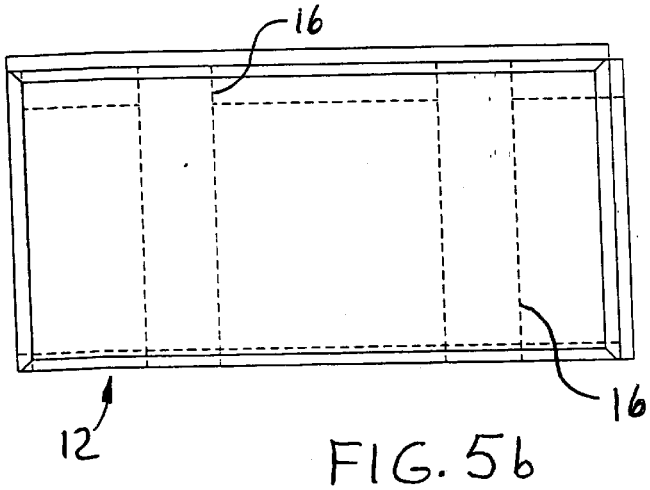
FIG. 5*b* is a side elevation view of a masonry panel block capable of accepting reinforcing rod with DRCs of FIG. 5*a*, as used in constructing a course of the panel section of the block wall system of the present invention.
Figure 6B:
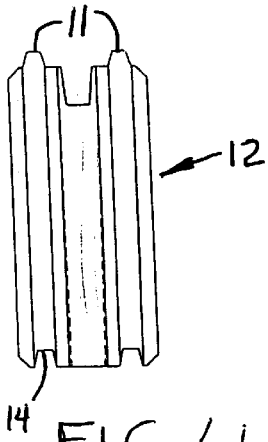
FIG. 6*b* is an end view of a masonry panel block capable of accepting reinforcing rod with DRCs of FIG. 6*a*, as used in constructing a course of the panel section of the block wall system of the present invention.
Figure 7:
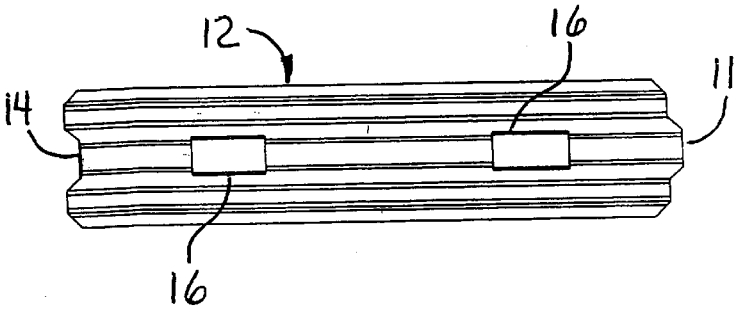
FIG. 7 is a top view of a masonry panel block capable of accepting reinforcing rod with DRCs of FIGS. 5*a* and 6*a*, as used in constructing a course of the panel section of the block wall system of the present invention.
Figure 8:
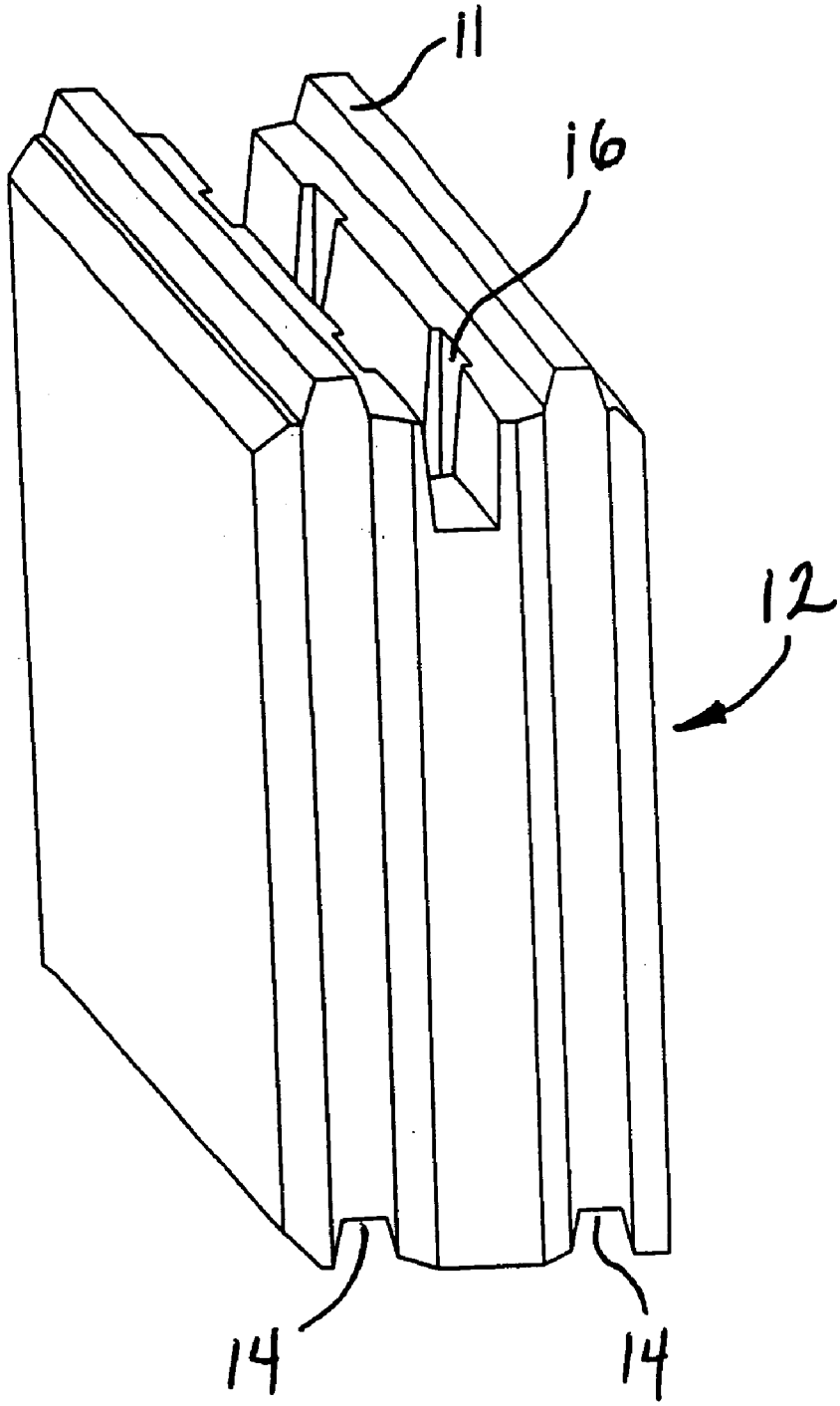
FIG. 8 is a perspective view of a masonry panel block used in constructing a course of the panel section of the block wall system of the present invention.
Figure 9A:
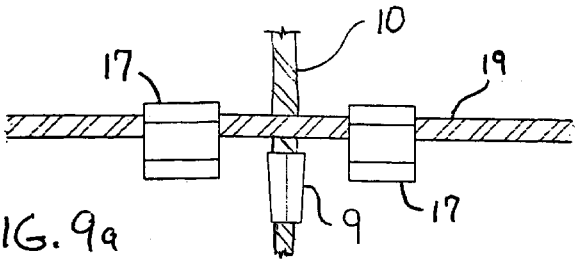
FIG. 9*a* is a side elevation view of vertical and horizontal reinforcing rods with DRCs as placed in a masonry pilaster block used in constructing a pilaster section of the block wall system of the present invention.
Figure 10A:
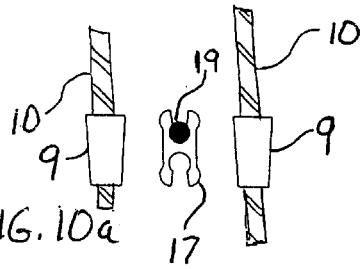
FIG. 10*a* is an end view of vertical and horizontal reinforcing rods with DRCs as placed in a masonry pilaster block used in constructing a pilaster section of the block wall system of the present invention.
Figure 9B:
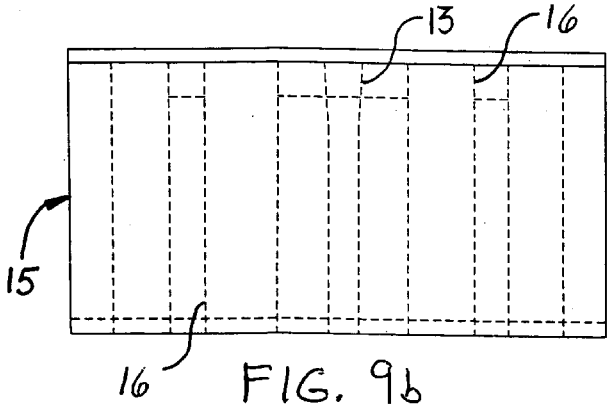
FIG. 9*b* is a side elevation view of a masonry pilaster block capable of accepting vertical and horizontal reinforcing rods with DRCs of FIG. 9*a*, as used in constructing a pilaster section of the block wall system of the present invention.
Figure 10B:
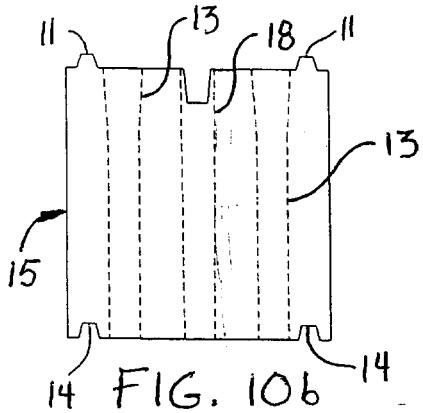
FIG. 10*b* is an end view of a masonry pilaster block capable of accepting vertical and horizontal reinforcing rods with DRCs of FIG. 10*a*, as used in constructing a pilaster section of the block wall system of the present invention.
Figure 11:
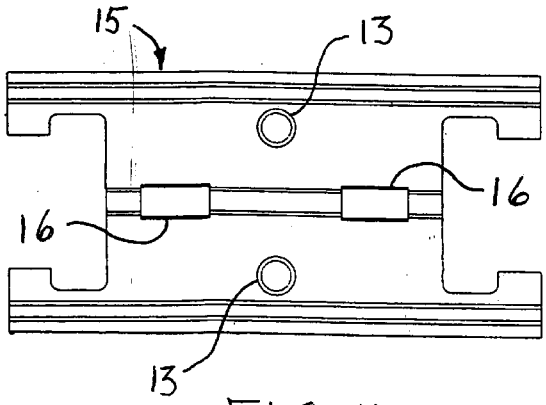
FIG. 11 is a top view of a masonry pilaster block capable of accepting vertical and horizontal reinforcing rods with DRCs of FIGS. 9*a* and 10*a*, as used in constructing a course of the panel section of the block wall system of the present invention.

Referring to FIGS. 1, 2 and 4, piers 3 are provided at predetermined intervals along a block wall with each pier terminating substantially at or slightly below grade level. Piers 3 provide support for the block wall of the present invention while minimizing the amount of concrete necessary in the formation of the block wall system. Piers 3 may be formed using a conventional cardboard cylinder, forming a cylindrical cavity for pouring concrete. Once dry, the concrete in the cylindrical cavity provides a near grade level-bearing surface for a block wall made according to the invention described below. The requirements for the bearing surface of piers 3 may be determined by building codes or other standards. In freezing climates the use of piers 3 instead of conventional footings, which are required to extend below the freeze line, represents a substantial savings in the cost of building the block wall system of the present invention.

The piers are constructed by placing vertical reinforcing rods 10 in concrete cylinder forms and pouring concrete into the forms and allowing the concrete to set. Alternatively, placement of the vertical reinforcing rods 10 can be determined and performed by first pouring concrete into the cylinder form and placing a pilaster block 15 as shown in FIGS. 1 and 4, directly over and centered on the pier cylinder forms, next placing rods 10 through holes 13 in pilaster block 15, and down into piers 3 before the concrete sets. Vertical reinforcing rods 10 can be conventional steel reinforcing bars or may be made of other metals, plastics or materials suitable for placement within masonry blocks to provide strength.

A grade beam can be used where poor soil conditions exist, such as soft subgrade soil. The grade beam can be made of a variety of materials such as steel, concrete, or other suitable materials for building a supporting structure. For example, a grade beam may be constructed using conventional masonry blocks reinforced horizontally with a reinforcing rod and filled with concrete to form a rigid grade beam at grade level 8. A grade beam, when necessary, may be constructed or cast and poured at the same time the concrete in the cylinders is poured. The grade beam may also consist of a steel or plastic bar that spans between the piers either entirely or partially supported by the soil. The grade beam may rest at or below grade level.

Figure 3:
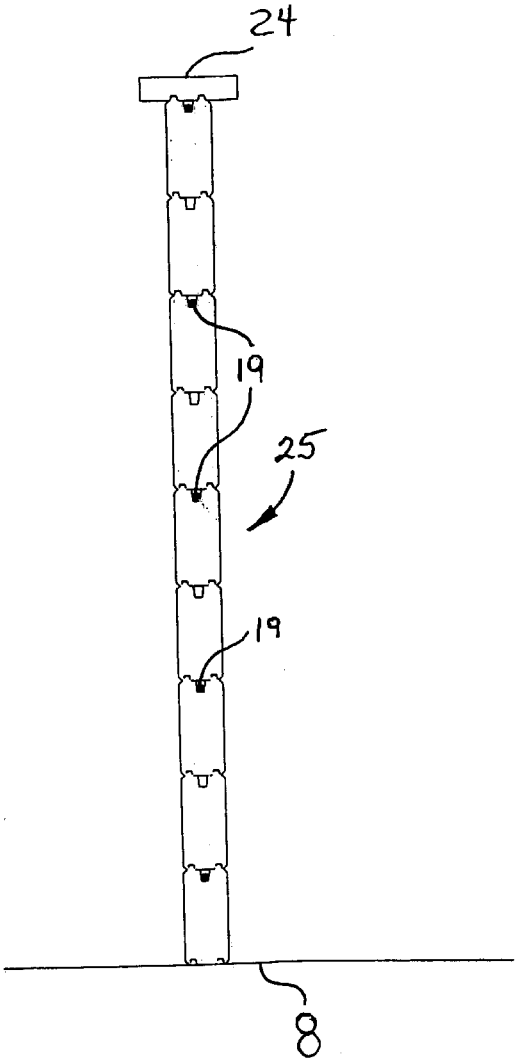
FIG. 3 is a cross-sectional view of the block wall system of FIG. 1 taken along line 3—3.

Resting at grade level on the piers 3 can be a first horizontal row of blocks containing pilaster blocks 15 and panel blocks 12 spanning adjacent piers 3 and supported by piers 3 as shown in FIGS. 1, 3 and 4. If a grade beam is used, then the first row of blocks will rest on the grade beam. If grade level is not horizontal the block wall system may follow a sloping grade using a stepped wall. The use of piers 3 to create a stepped wall is well known in the art. Once the concrete in piers 3 sets with vertical reinforcing rods 10 and first pilaster block in place as shown in FIGS. 1 and 4, the first course of panel blocks 12 may be placed between the pilaster blocks 15 resting on the piers 3. Vertical reinforcing rods 10 at each of the piers 3 may be guided through holes 13 in each of the pilaster blocks 15 as the pilaster block is put into place above each pier. Pilaster blocks 15 will form a pilaster 20 over each of the piers 3 as successive courses of blocks are placed as shown in FIGS. 1 and 4.

Figure 12A:
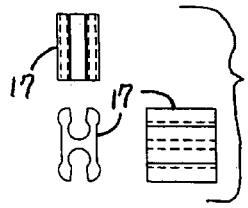
FIG. 12*a* is a top, side and end view of a DRC capable of accepting a horizontal reinforcing rod of FIGS. 5*a*, 6*a*, 9*a* and 10*a*.
Figure 12B:
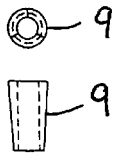
FIG. 12*b* is a top, side and end view of a DRC capable of accepting a vertical reinforcing rod of FIGS. 9*a* and 10*a*.
Figure 13:
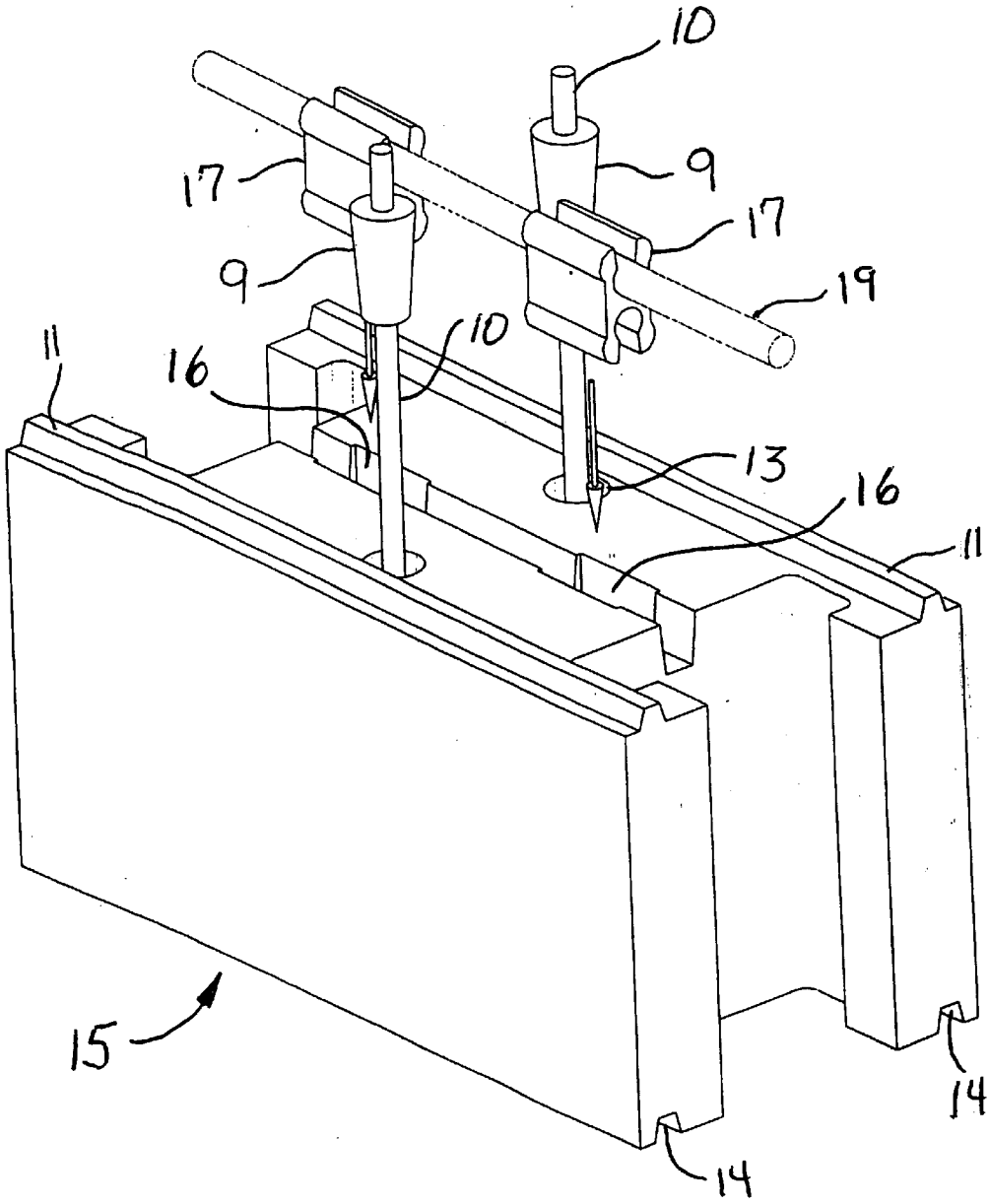
FIG. 13 is a perspective view of a masonry pilaster block showing vertical and horizontal reinforcing rods and DRCs as used in constructing a pilaster section of the block wall system of the present invention.
Figure 14:
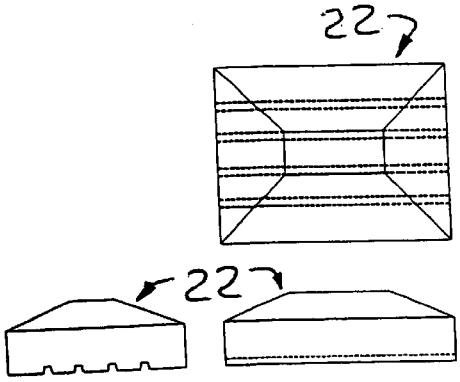
FIG. 14 is a top, side and end view of a masonry pilaster block cap used in constructing a pilaster section of the block wall system of the present invention.
Figure 15:
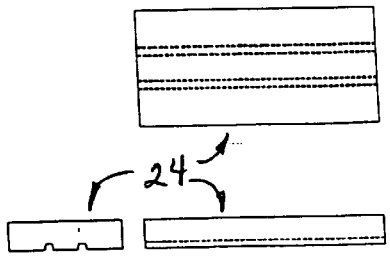
FIG. 15 is a top, side and end view of a masonry panel block cap used in constructing a pilaster section of the block wall system of the present invention.

After the first pilaster block 15 is placed above each of the piers 3 and the concrete in piers 3 is set, the vertical reinforcing rods 10 may be attached to pilaster blocks 15 using DRCs 9 (FIGS. 12*b* and 13), or adhesives, or other means of attaching vertical reinforcing rods 10 to pilaster blocks 15. However, grout is not required to attach vertical reinforcing rods 10 to pilaster blocks 15 nor is mortar required in placing each course of panel and pilaster blocks. Post tensioning can be used for the pilaster 20 where added strength is needed or desired. Post tensioning techniques are well known, however conventional post tensioning is used along the entire length of a block wall having a grade beam or foundation along the entire length of the wall to attach the post-tensioning rods. In the present invention, post tensioning can be employed to strengthen the pilasters blocks 15 that make up the pilasters 20, but not the panel blocks 12 forming panel 25 between pilasters when there is no grade beam used in the block wall system. When post tensioning is used, mortar may be used on pilaster blocks 15, but is still not required for the panel 25 comprising panel blocks 12. If post tensioning is used, vertical reinforcing rods 10 are post-tensioning rods commonly known in the art, and pilaster 20 may be constructed using post-tensioning techniques well known in the art.

After the first pilaster block 15 is in place over each of the piers 3, the first course of panel blocks 12 may be placed as shown in FIG. 1. Panel blocks 12 and pilaster blocks 15 may be any interlocking or tongue-and-groove block configuration that allows stacking of the panel blocks and pilaster blocks without the need for mortar or grout. Panel blocks 12 and pilaster blocks 15 may be configured to allow for placement of DRCs 17. Pilaster block 15 may also be configured to provide for placement of DRCs 9. Referring to FIGS. 5*a*, 5*b*, 6*a*, 6*b*, 9*a*, 9*b*, 10*a*, 10*b* and 12*a*, DRCs 17 may be any structure capable of attachment to the panel blocks 12 and pilaster blocks 15 while allowing for placement of reinforcement rods 19. For added strength, conventional adhesives used for bonding concrete surfaces may be employed between adjoining pilaster blocks 15 and/or panel blocks 12, or where a watertight seal is required, a sealant such as caulking may be used between the panel blocks 12 and/or pilaster blocks 15. Referring to FIGS. 6*b*, 7, 8, 10*b* and 13 panel blocks 12 and pilaster blocks 15 may have one or more extended surfaces 11 that fit into matching grooves 14 on adjacent courses of panel blocks. FIGS. 1, 2, 3 and 4 show examples of the stacking nature of these interlocking or tongue-and-groove block configurations, however many different interlocking configurations are known in the art and may be used as panel blocks.

After each panel block 12 is put in place along a course or row, DRCs 17 can be secured to one or more recessed channels 16 or other void which allows the placement of reinforcement rod 19 between adjacent panel blocks 12 as shown in FIGS. 1, 3, 4, 5*a*, 5*b*, 6*a*, and 6*b*. Similarly, DRCs 17 may be secured to one or more recessed channels 16 or voids in pilaster blocks 15 as shown in FIGS. 1, 3, 4, 9*a*, 9*b*, 10*a*, 10*b*, 11 and 13. Panel blocks 12 interlock with pilaster blocks 15 at the ends of each panel 25 as shown in FIGS. 1 and 2. Once a course or row of pilaster blocks 15 and panel blocks 12 is in place, reinforcing rods 19 are attached to DRCs 17 by snapping or gluing reinforcing rods 19 horizontally in place. Horizontal reinforcing rods 19 may run the entire length of the wall to provide a rigid connection between horizontally adjacent blocks in the block wall system of the present invention. Reinforcing rod 19 may be any rod, pipe, bar, strip, or similar device capable of providing strength when attached to adjoining panel blocks and pilaster blocks. At either end, or both ends, of the panel blocks 12 comprising a row in panel 25 a wedge or similar device may be placed between the panel row and the adjacent pilaster to fill any gap between the pilaster block 15 and panel block 12. The wedge or similar device may be made of wood, rubber, or any other suitable material that will firmly compress panel blocks 12 against corresponding adjacent pilaster blocks 15 while allowing for expansion and contraction of the panel blocks. As shown in FIGS. 1, 2 and 3, pilaster 20 may be anchored to the piers 3 by vertical reinforcing rods 10 and may also be anchored to panel 25 by horizontal reinforcing rods 19 providing a network of interlocking horizontal and vertical reinforcing rods to provide strength and support for the block wall system of the present invention.

Each successive course or row of pilaster blocks 15 and panel blocks 12 in the block wall system is constructed in essentially the same manner as the first row, the pilaster blocks 15 are placed directly on top of the pilaster block 15 of the prior course or row. Panel blocks 12 can be placed in a staggered manner as shown in FIG. 1, each successive row shifted to the right or left such that each panel block 12 straddles two panel blocks beneath except at the ends of the row where a half panel block can be used to for the panel block which attaches to an adjoining pilaster block. DRCs 17 and horizontal reinforcing rods 19 may be placed along the blocks in every course or row of the wall, or the horizontal reinforcement rods 19 can be employed in every other course or row, or less frequently. The wedges or similar devices may be used to compress each course or row of panel blocks 12 against corresponding adjacent pilaster blocks 15 of the same row as each course or row is constructed.

When the last course or row of blocks has been placed at the desired height of the block wall, the top pilaster blocks 15 may be capped with pilaster cap blocks 22, and panel blocks 12 may be capped with panel cap blocks 24 as shown in FIGS. 1, 3, 4, 14 and 15. If post tensioning is used on the pilasters 20, then vertical reinforcing rods 10 will be tensioned using known post tensioning techniques before pilaster cap block 22 is placed on top of pilasters 20. Pilaster cap blocks 22 and panel cap blocks 24 may be secured in place with adhesives, anchor DRCs, or other known techniques for attaching capping blocks to a block wall system.

DRCs 9 and DRCs 17 may be made of any material or mechanism for attaching vertical and horizontal reinforcing bars to panel blocks 12 and pilaster blocks 15 without the use of grout such that deflection of the reinforcing bars within the voids of the blocks is acceptably reduced under anticipated loading conditions. DRCs attach reinforcing rods running vertically and horizontally through panel blocks 12 and pilaster blocks 15 thereby connecting rows and columns of blocks together while providing strength and stability to the block wall system. The DRCs may be shaped to snugly attach to reinforcing rods while fitting tightly into a groove or void in the blocks. The DRCs may not fill the entire void within the panel blocks or pilaster blocks unlike grout, thereby saving material and costs.

In alternative embodiments, horizontal post tensioning may be used within panels 25 by attaching reinforcing rods 19 to the top clip portion of DRCs 17 in the panel blocks at both ends of the panel, while attaching reinforcing rods 19 from the pilaster to the bottom clip portion of DRCs 17 in the panel blocks at both ends of the panel. The horizontal post tensioned reinforcing rod 19 may have plates and bolts at both ends to tighten and compress the panel blocks in given row and adjacent rows, thereby providing added strength in the rows and adjacent rows where horizontal post tensioning is used. The use of horizontal post tensioning may reduce the number of DRCs required for internal panel blocks and will reduce the need for a grade beam where horizontal post tensioned panels are supported by piers 3 on both ends of the panel.

The block wall system of the present invention provides a durable and secure fencing or retaining wall system that is economically installed without skilled labor and with substantial reductions in material costs and labor costs over conventional block wall systems. The use of piers reduces material costs and labor expenses while simplifying the installation in freezing climates. The elimination of grout and mortar greatly simplifies the construction process while eliminating the need for a mason or other skilled worker to construct the wall. The resulting block wall structure will be less expensive while providing the necessary system strength and integrity. Where added strength is desired, the use of post tensioning on the pilasters provides substantial added strength without substantially increasing the cost or difficulty in constructing the block wall system.

While the above is a complete description of the preferred embodiments of the invention, various alternatives, modifications, and equivalents may be used. Therefore, the above description should not be taken as limiting the scope of-the invention which is defined by the appended claims.

What is claimed is:

1. A masonry block wall system comprising:

(a) a plurality of piers positioned at predetermined intervals along a masonry block wall system with a pilaster mounted on each said pier;

(b) each said pilaster comprising vertically stacked pilaster blocks attached to said pier by a reinforcing rod extending upwardly from said pier;

(c) a plurality of courses of masonry panel blocks forming block wall panels, each of said panel blocks in said panels having groutless voids therein, and having mortarless horizontal and vertical joints between adjacent courses of said panel blocks;

(d) selected courses of pilaster blocks and panel blocks having a horizontal reinforcing rod attached to each pilaster block and panel block in said course; and (e) said horizontal reinforcing rods attached to said panel blocks using deflection restraint clips without the use of mortar, grout, or concrete, and said horizontal reinforcing rods also attached to said pilaster blocks in said selected courses to anchor said block wall panels to adjoining pilasters.

2. The masonry block wall system of claim 1 wherein said vertical reinforcing rod in each said pilaster is a post tensioning rod.

3. The masonry block wall system of claim 1 wherein said horizontal and vertical joints between adjacent panel blocks contain means for bonding said joints.

4. The masonry block wall system of claim 1 wherein said horizontal and vertical joints between adjacent panel blocks contains a non-mortar sealant for sealing said joints.

5. The masonry block wall system of claim 1 wherein a grade beam supports said block wall panels.

6. The masonry block wall system of claim 2 wherein said horizontal and vertical joints between adjacent panel blocks contain means for bonding said joints.

7. The masonry block wall system of claim 2 wherein said horizontal and vertical joints between adjacent panel blocks contains a non-mortar sealant for sealing said joints.

8. The masonry block wall system of claim 2 wherein a grade beam supports said block wall panels.

9. A method of forming a masonry block wall system having a plurality of courses of masonry blocks, comprising the steps of:

(a) forming a plurality of concrete piers by pouring concrete into pier forms which terminate at grade level;

(b) inserting vertical reinforcing rods into said concrete before said concrete sets;

(c) laying pilaster blocks above said piers with said reinforcing rods passing through voids in said pilaster blocks;

(d) laying a first course of panel blocks between each of said pilaster blocks;

(e) laying a plurality of courses of panel blocks to form panels with mortarless interlocking horizontal and vertical joints in said panels;

(f) laying a plurality of pilaster masonry blocks for each course of panel blocks to form pilasters; and (g) attaching a horizontal reinforcing rod to selected ones of said courses of panel blocks using deflection restraint clips without the use of mortar, grout, or concrete, and also attaching said horizontal reinforcing rod to said pilaster blocks in said selected courses to anchor said block wall panels to adjoining pilasters.

10. The method of forming a masonry block wall system of claim 9 further comprising the step of applying post tensioning to each of said pilasters in said block wall system.

11. The method of forming a masonry block wall system of claim 9 further comprising the step of applying a non-mortar bonding agent to said horizontal and vertical joints between adjacent panel blocks.

12. The method of forming a masonry block wall system of claim 9 further comprising the step of applying a non-mortar sealing agent to said horizontal and vertical joints between adjacent panel blocks.

13. The method of forming a masonry block wall system of claim 9 further comprising the step of forming a grade beam to support said panels.

14. The method of forming a masonry block wall system of claim 10 further comprising the step of applying a non-mortar bonding agent to said horizontal and vertical joints between adjacent panel blocks.

15. The method of forming a masonry block wall system of claim 10 further comprising the step of applying a non-mortar sealing agent to said horizontal and vertical joints between adjacent panel blocks.

16. The method of forming a masonry block wall system of claim 10 further comprising the step of forming a grade beam to support said panels.

17. A masonry block wall system comprising:

(a) a plurality of piers positioned at predetermined intervals along a masonry block wall system with a pilaster mounted on each said pier;

(b) each said pilaster comprising vertically stacked pilaster blocks attached to said pier by a reinforcing rod extending upwardly from said pier;

(c) a plurality of courses of masonry panel blocks forming block wall panels, each of said panel blocks in said panels having groutless voids therein, the horizontal and vertical joints between adjacent courses of said panel blocks;

(d) selected courses of pilaster blocks and panel blocks having a horizontal reinforcing rod attached to each pilaster block and panel block in said course; and (e) said horizontal reinforcing rods attached to said panel blocks using a bonding agent without the use of mortar, grout, or concrete, and said horizontal reinforcing rods also attached to said pilaster blocks in said selected courses to anchor said block wall panels to adjoining pilasters.

18. The masonry block wall system of claim 17 wherein said vertical reinforcing rod in each said pilaster is a post tensioning rod.

19. The masonry block wall system of claim 17 wherein said horizontal and vertical joints between adjacent panel blocks contain means for bonding said joints.

20. The masonry block wall system of claim 17 wherein said horizontal and vertical joints between adjacent panel blocks contains a non-mortar sealant for sealing said joints.

21. The masonry block wall system of claim 17 wherein a grade beam supports said block wall panels.

22. The masonry block wall system of claim 18 wherein said horizontal and vertical joints between adjacent panel blocks contain means for bonding said joints.

23. The masonry block wall system of claim 18 wherein said horizontal and vertical joints between adjacent panel blocks contains a non-mortar sealant for sealing said joints.

24. The masonry block wall system of claim 18 wherein a grade beam supports said block wall panels.

* * * * *